US006012951A

United States Patent [19]

Krawez et al.

[11] Patent Number: 6,012,951

[45] Date of Patent: Jan. 11, 2000

[54] PHONE PLUG FOR A PHONE LINE SYSTEM INCLUDING A HOME DATA NETWORK

[75] Inventors: Cliff Krawez, Santa Clara; Paul B. Ripy, Fremont, both of Calif.

[73] Assignee: Broadmedia, Inc., Sunnyvale, Calif.

[21] Appl. No.: 09/191,883

[22] Filed: Nov. 13, 1998

[51] Int. Cl.[7] ..... H01R 13/66

[52] U.S. Cl. ..... 439/620

[58] Field of Search ..... 439/620, 638, 439/676

[56] References Cited

U.S. PATENT DOCUMENTS

| | | | |
|---|---|---|---|
| 5,310,360 | 5/1994 | Perterson | 439/571 |
| 5,397,250 | 3/1995 | Briones | 439/620 |
| 5,419,716 | 5/1995 | Sciammarella et al. | 439/540 |

*Primary Examiner*—Steven L. Stephan
*Assistant Examiner*—Javaid Nasri
*Attorney, Agent, or Firm*—Joe Zheng; Chi-Ping Chang

[57] ABSTRACT

An improved phone plug comprises a housing having a rear-receiving end and a plugging end, a number of inductors and conductors. The plug-receiving socket is formed in the rear-receiving end and adapted to receive a modular phone plug; the plugging end being so formed that the plugging end can be plugged into a regular phone jack coupled to the phone line system including the data network. The conductors are mounted in the housing and have first ends and second ends; the first ends projecting into the plug-receiving socket for engaging a contact of the modular phone plug when the modular phone plug is inserted into the plug-receiving socket; the second ends coupled respectively to the plugging end through the inductors.

10 Claims, 7 Drawing Sheets

PHONE PLUG FOR A PHONE LINE SYSTEM INCLUDING A HOME DATA NETWORK

BACKGROUND OF THE INVENTION

1. Field of the Invention

The present invention generally relates to electronic connectors and more particularly relates to an improved phone plug for telephones that share a home data network implemented upon a phone line system in a residential home.

2. Description of the Related Art

The Internet is a rapidly growing communication network of interconnected computers and computer networks around the world. Together, these millions of connected computers form a vast repository of multimedia information that is readily accessible by any of the connected computers from anywhere at any time. Just as there is a critical need for high-speed connections to the information on the Internet, there is a growing need to rapidly move information between devices within a home, for example, data transferring from a first computing device in one room to a second computing device in another room. Businesses accomplish this by deploying Local Area Networks (LANs); however, networks are not commonly deployed in the home due to the cost and complexity of installing the new wiring system typically required by the traditional LANs. Nevertheless, there exists a phone line system in nearly every home in the United States. Therefore a demand for a simple high-speed and cost-effective home network based on the existing phone line system is tremendously growing.

The driving force behind the home network is the growth of on-line households and the growing number of homes with two or more personal computers. It is reported that more than 47 percent of U.S. households are likely to have Internet access devices by 2002, with some 20 percent of this subset owning multiple devices that need to share access to the Internet as well as each other. With the increased focus on computers in education and the boom in Internet connectivity, a large number of personal computers being purchased today are additional personal computers, as opposed to replacement units. Today, it is estimated that over 15 million of the nearly 100 million homes in the United States have two or more personal computers. This number is growing 30 percent annually.

FIG. 1 shows a home data network over an existing wiring structure in a residential home. There is a computer 102 and a printer 104 coupled to a pair of phone lines 100 for data communication therebetween. The phone lines 100 are pre-existent and primarily for the telephone 106 or 108 for voice communication with the outside world through the public switched telephone network (PSTN) 110. It is generally understood that each telephone device presents small capacitance to the phone lines 100. Typically, the frequency of voice communication is low and hence the capacitance does not affect the voice communication over the phone lines 100. When the same phone lines 100 are used for data communication with the capacitance from the coupled telephone devices, the capacitance can significantly affect the signal quality of the data communication between the computing devices. The reason is primarily due to the very high signal frequency in the data communication. There is therefore, a great need for a cost-effective solution that can alleviate the effect from the capacitance of the telephone devices in data communication over a data network implemented upon a telephone line system.

SUMMARY OF THE INVENTION

The present invention has been made in consideration of the above described problems and needs. The disclosed invention provides a simple generic solution to the capacitance problem introduced by telephone devices coupled onto a phone line system upon which a data network is implemented. The capacitance results in low impedance (loading effects) across the data network when high frequency data are transmitted therein. As a result, the data signals available to a computing device becomes degraded due to the high impedance. An improved phone plug disclosed herein uses an inductance circuit to block the loading effects so as to maintain the signals quality.

According to one embodiment of the present invention, the inductance circuit comprises an inductor. The improved phone plug comprises a housing having a rear-receiving end and a plugging end, a number of inductors and conductors. The plug-receiving socket is formed in the rear-receiving end and adapted to receive a modular phone plug; the plugging end being so formed that the plugging end can be plugged into a regular phone jack coupled to the phone line system including the data network. The conductors are mounted in the housing and have first ends and second ends; the first ends projecting into the plug-receiving socket for engaging a contact of the modular phone plug when the modular phone plug is inserted into the plug-receiving socket; the second ends coupled respectively to the plugging end through the inductors.

In other words, rather than having a telephone device connected to the phone line system directly, the telephone device is coupled to the phone line system through inductors so as to minimize the capacitance impact on the data communication.

Accordingly, one of the objects of the present inventions is to provide a simple and generic solution to minimizing the capacitance impact from phone devices on the data communication.

Other objects, together with the foregoing are attained in the exercise of the invention in the following description and resulting in the embodiment illustrated in the accompanying drawings.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENTS

Figure 1:
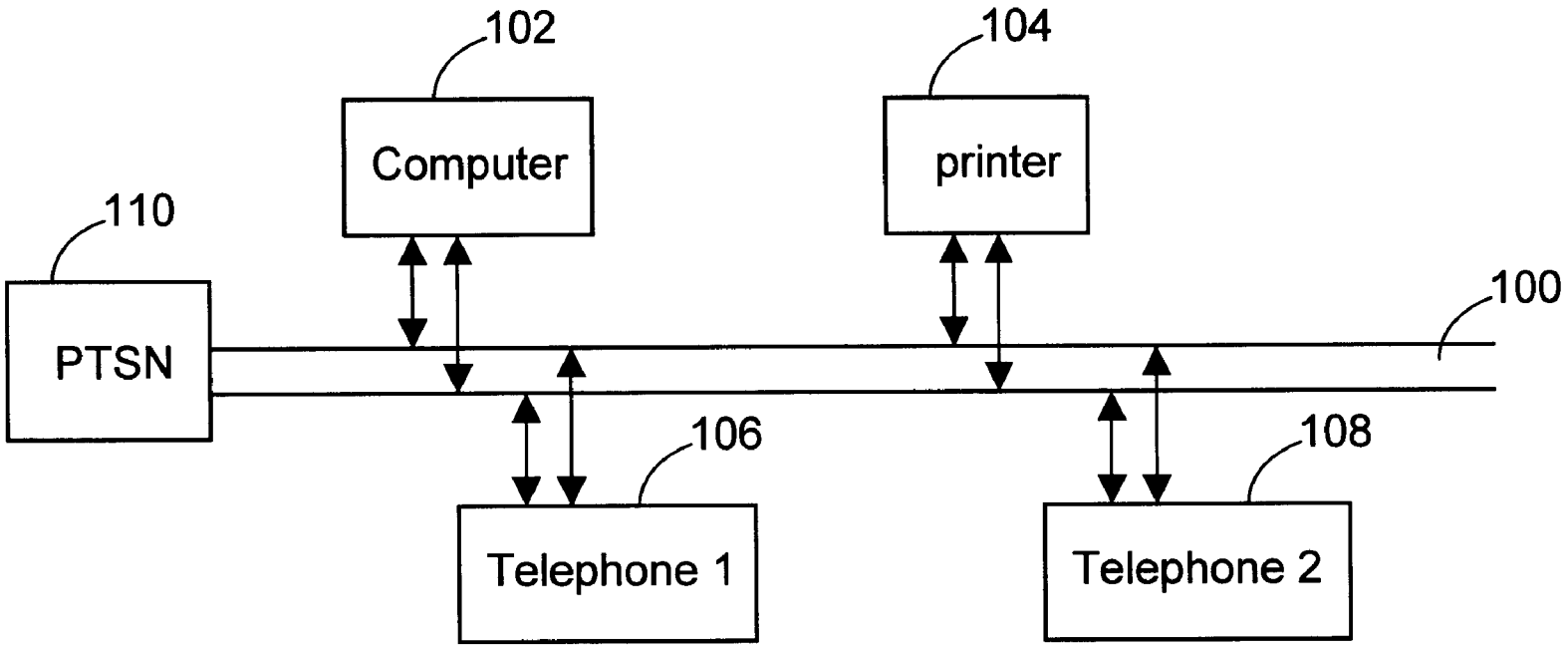
Fig. 1 (Prior Art)
FIG. 1 shows a home data network over an existing wiring structure in a residential home.
Figure 2:
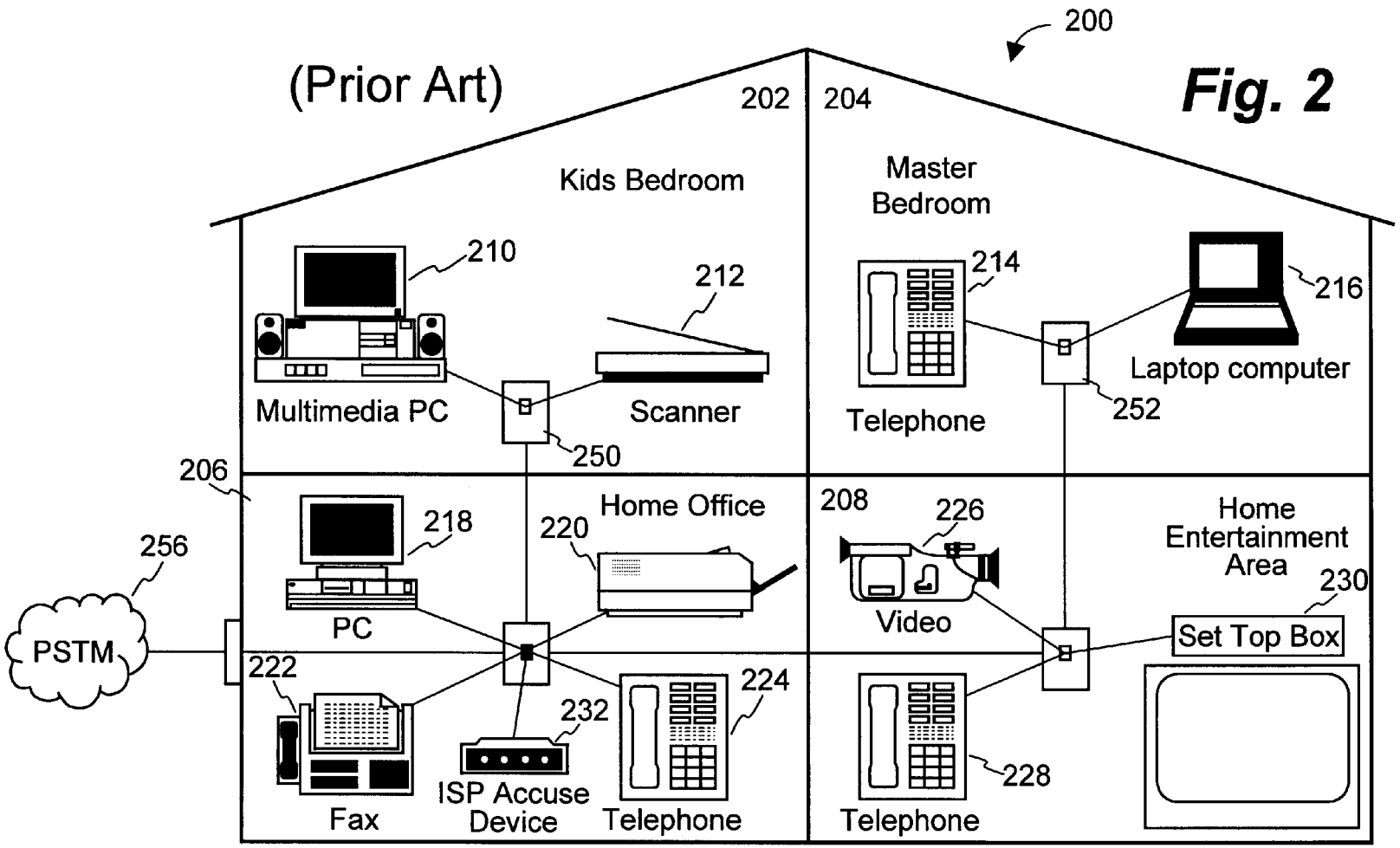
Fig. 2 (Prior Art)
FIG. 2 shows a home configuration in which the present invention may be practiced.

Referring now to the drawings, in which like numerals refer to like parts throughout the several views. FIG. 2 shows a home configuration in which the present invention may be practiced. As shown in the figure, there are four rooms 202, 204, 206 and 208 in the house 200, each having electronic devices that are coupled to a home data network. The home data network is implemented upon a phone line system in the house 200 and may be coupled to the Internet via an internet service provider access device 232.

With reference to the figure, there is a multimedia personal computer 210 and a scanner 212 in the kids bedroom 202, a telephone 214 and laptop personal computer 216 in the master bedroom 204, a desktop personal computer 218, a printer 206, a telephone 224 and a fax machine 222 in the home office 220, and a video camera 226, a telephone 228 and a set top box 230 in the home entertainment area 208. To be more specific, telephones 214, 224 and 228 and fax machine 222 are generally coupled to the phone line system for phone services while other devices, referred to herein as computing devices, are coupled to the phone line system for home data networking. Each of the computing devices may share data produced in another device. For example, The scanner 212 in the kids room generates an image of a picture, the image can be transmitted to the personal computer 218 for further editing process and finally the edited image can be printed from the laser printer 220, all via the home data network.

Graphically, the home data network is overlapping the phone line system because it is implemented over the phone line system. Although all devices are connected to the same phone line system, only telephones 214, 224 and 228 and fax machine 222 communicate with the public switched telephone network (PSTN) 256. The rest of the devices communicate over the home data network may or may not communicate with PSTN 256 but communicate among themselves.

Figure 3A:
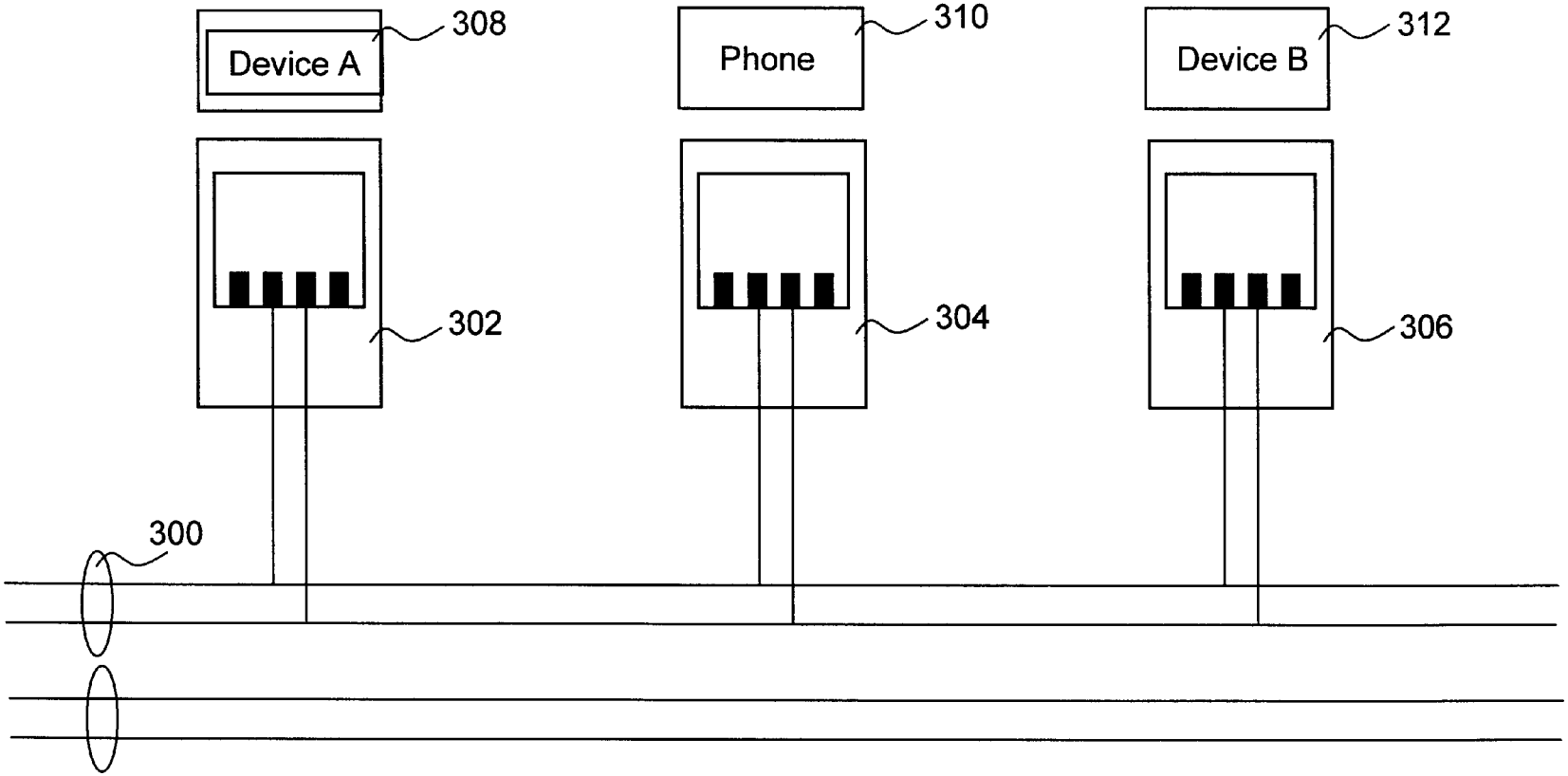
Fig 3A (Prior Art)
FIG. 3A illustrates an example of how three wall outlets (phone jack sockets) are coupled to a pair of wires of an existing 4-wire phone line system, commonly in a residential home.

FIG. 3A illustrates an example of how three wall outlets (phone jack sockets) 302, 304 and 306 are coupled to a pair of wires 300 of an existing 4-wire phone line system, commonly in a residential home. Each of the wall outlets 302, 304 and 306 has two pairs of connectors. It is assumed that the center two connectors are used for connection to wires 300. As illustrated in the figure, device 300, phone 310 and device 312 are coupled to wires 308 through outlets 302, 304, and 306, respectively. For example, device 308 is a computer and device 312 is a printer. One application of the data communications between two devices 308 and 312 is to print on device 312 data from device 308.

Figure 3B:
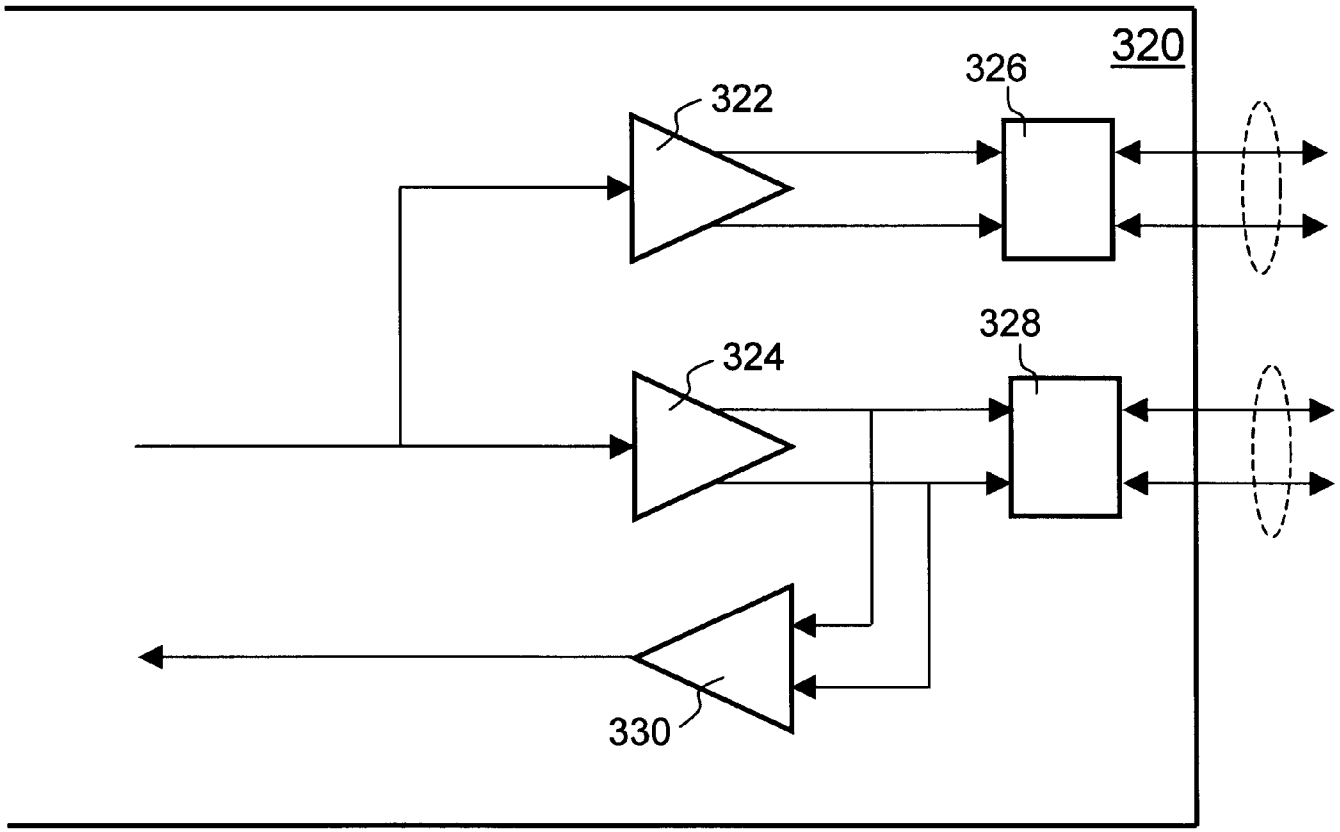
FIG. 3B shows a possible home network interface in a network card that can be in a computing device.

FIG. 3B shows a possible home network interface 320 in a network card that can be in a computing device, such as device 308 and device 312, for data communication over the phone line system. The interface 320 comprises two differential transmitters 322 and 324. Differential transmitters 322 and 324 are respectively referred to as the primary and secondary differential transmitters, indicating that the primary differential transmitter is coupled to one pair of wires and the secondary differential transmitter is coupled to the secondary pair of wires in the phone line system. Each of the differential transmitters 322 and 324 is coupled to the telephone line system via a respective line isolator 326 or 328. It is understood to those skilled in the art that the line isolator 326 or 328 used herein is to decouple the differential transmitter from the regular telephone service access. There are many available isolators such as capacitor isolator or transformer isolator that may be used.

As shown in the figure, a data stream to be communicated over the home network is fed to both differential transmitters 322 and 324 that further send the data stream to both pairs of wires in the phone line system, thereby all devices coupled to the phone line system, regardless which pair of wires being coupled onto, can receive the data stream.

Because the transmission from a computing device that transmits the data stream is coming from both pairs of the wires, namely either one of the pairs of wires in the phone line system, there is, therefore, needed only one differential receiver. Hence the interface 320 further comprises a differential receiver 330, coupled to one of the line isolators 326 or 328 to receive a data stream from the home network.

Figure 3C:
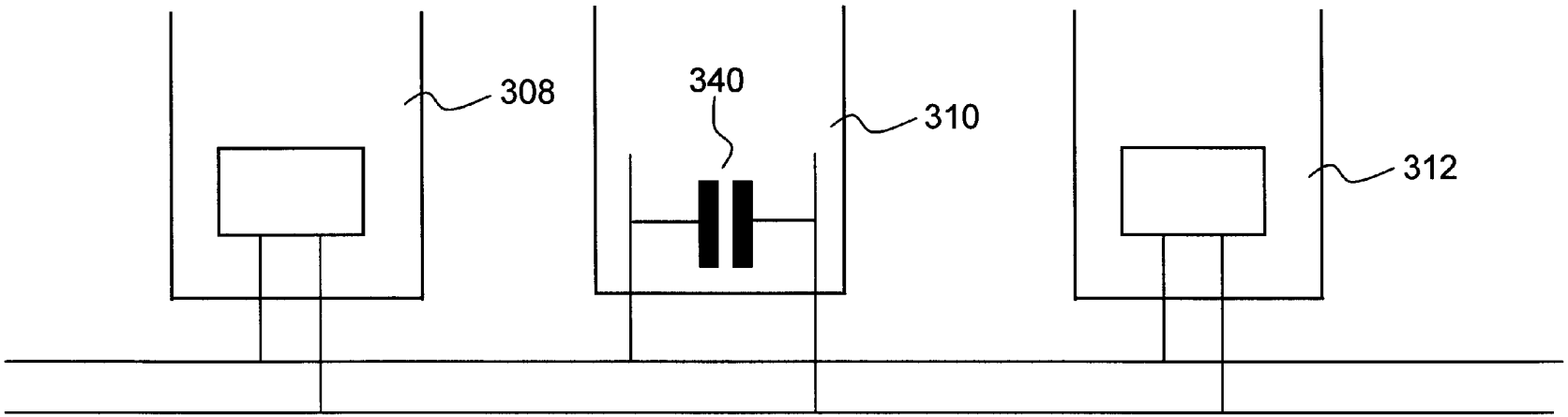
FIG. 3C shows a connection of FIG. 3A in conjunction of FIG. 3B from a circuit perspective.

Referring to FIG. 3C now, there is shown a connection of FIG. 3A in conjunction of FIG. 3B from a circuit perspective. A telephone set being plugged to a jack socket (e.g. a RJ11 jack) presents a capacitor 340 across the data network. If it is assumed that the output impedance of each of the interface is 100Ω and the capacitance C of the capacitor is 1000 PF. At 7.5 MHz, the impedance of the capacitor will be approximated:

$$1/\omega C=1/(2\times\pi\times7.5\times10^{6}\times1000\times10^{-12})\approx21\Omega;$$

If it is further assumed that the voltage available to a differential receiver in a network interface is 1.2 V, then the actual voltage received by the differential receiver in the network interface is approximated:

$$1.2\times21/(100+21)=0.2\text{ V};$$

which shows that data signals received for data communication have been considerably degraded due to the capacitance from a telephone device.

Figure 4A:
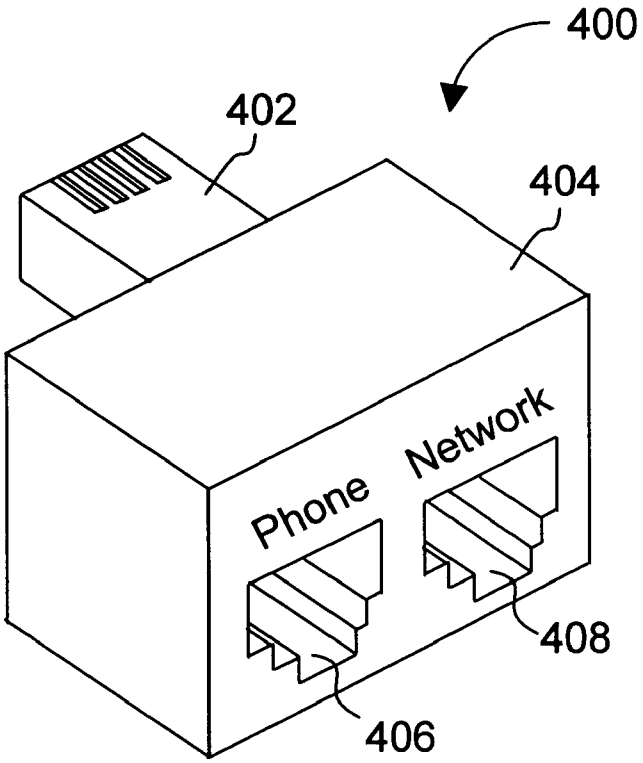
FIG. 4A shows one exemplary phone plug in which the present invention may be practiced.

FIG. 4A shows one exemplary phone plug in which the present invention may be practiced. Phone plug 400, housed in a housing or case that is preferably made out of solid plastic material, comprises two parts, a plugging end 402 and a rear-receiving end 404. Plugging end 402 is just like a corresponding portion of a regular phone plug assembly and can be inserted into a regular phone jack in a residential home. Rear-receiving end 404 includes a pair of plug-receiving sockets 406 and 408. Preferably plug-receiving socket 406 is for receiving a regular phone plug from a telephone device and plug-receiving socket 408 is for receiving a phone plug from a computing device. Further there are two sets of n conductors mounted in the housing. Each set, at one end, projects into a corresponding plug-receiving socket for engaging a contact of a phone plug when the phone plug is inserted into the plug-receiving socket. At the other end, the set for plug-receiving sockets 406 is coupled to plugging end 402 through a number of inductors, each for one conductor and the set for plug-receiving sockets 408 is directly coupled to plugging end 402. As described above, there are two pairs of wires in a typical home phone line system. Therefore one version of phone plug 400 is to use four inductors. To be more specific, there are respectively four conductors, at one end, projecting into each of the plug-receiving sockets in the rear-receiving end for engaging a contact of a regular residential phone plug when the phone plug is inserted. At the other end, the four conductors in the plug-receiving socket for telephone devices are respectively coupled to the plugging end (also including four conductors) through four inductors. In other words, a telephone device is coupled to the home line system through the inductors while a computing device is coupled directly to the home line system.

To continue the example above, it is assumed that the inductance L for each of the inductors is 50 $\mu$H. At 7.5 MHz, the impedance of the inductor is approximated:

$$\omega L=2\times\pi\times7.5\times10^{6}\times50\times10^{-6})\approx2.5\ k\Omega;$$

then the actual voltage received by the receiver is approximated:

$$1.2\times(21+2500+2500)/(100+21+2500+2500)=1.18\ \text{V};$$

wherein the inductor is counted twice as each of the pair of conductors is conducted to an inductor. The result obtained above is close to the actual voltage available to the interface. In other words, the data signals received for data communication have not been considerably degraded.

It may be appreciated by those skilled in the art that the introduction of passive inductance circuits or simply inductors in the phone plug maintains the signals quality in data communication meanwhile the quality of voice communication is not affected.

Figure 4B:
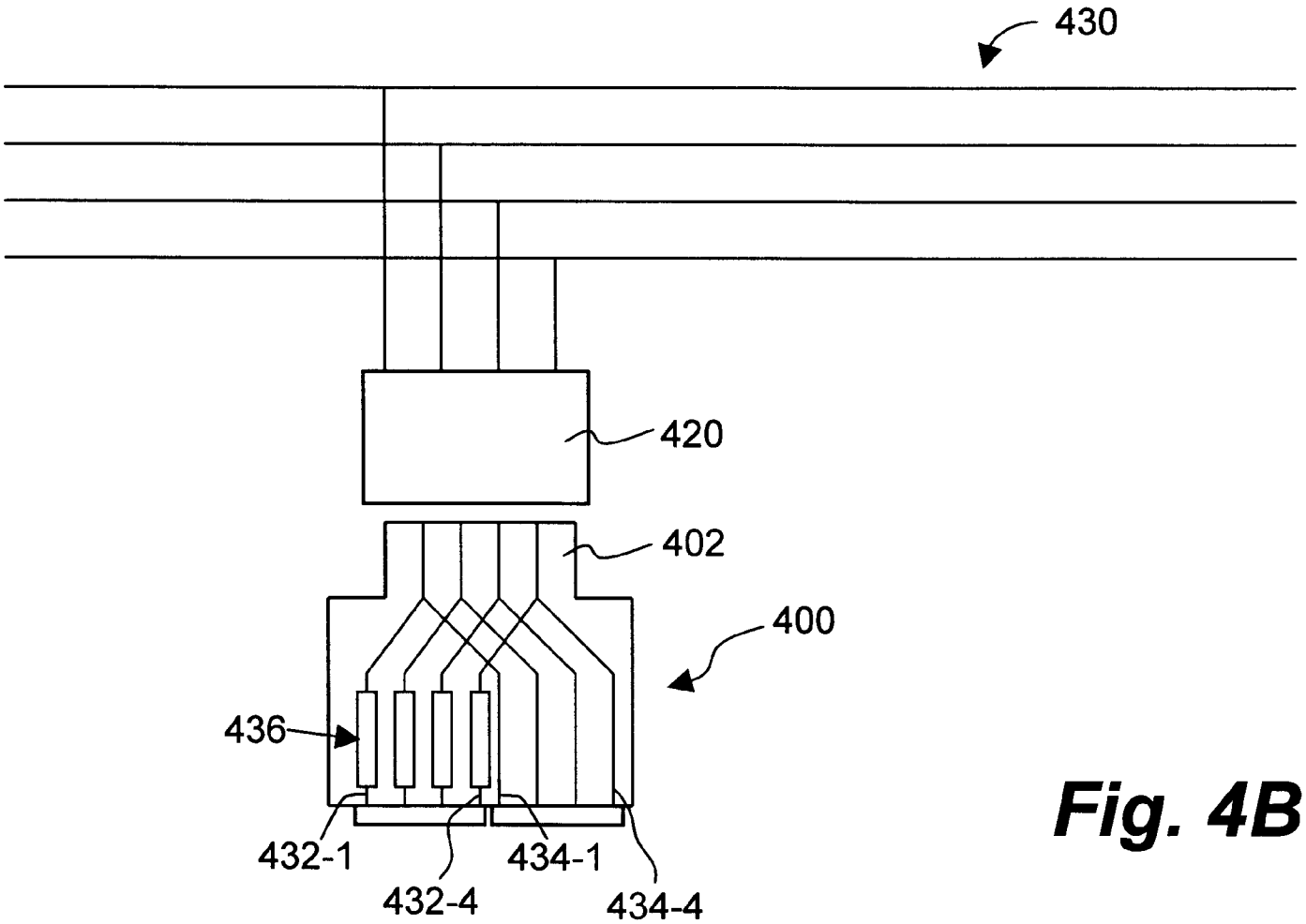
FIG. 4B shows an internal layout of improved phone plug.

FIG. 4B shows an internal layout of improved phone plug 400. When plugging end 402 is plugged into a phone jack 420, connectors 432 and 434 in plug-receiving sockets 406 and 408 are coupled to phone line system 430 in which a data network is implemented. More specifically, each of connectors 432 in plug-receiving sockets 406 is coupled to one of the connectors in phone plug 400 through an inductor while connectors 434 are directly and respectively coupled to the connectors in phone plug 400.

It should be pointed out that an improved phone plug 400 in FIGS. 4A and 4B is a preferred embodiment that provides two plug-receiving sockets, one for the phone device and one for the computing device, optionally each being visually identified or labeled. In another embodiment, the rear-receiving end in phone plug 400 comprises one or more plug-receiving sockets, all for telephone devices. In this case, all the connectors in the plug-receiving sockets are coupled to the plugging end through an array of inductors on a one-to-one basis or two-to-one basis. The one-to-one basis means that each of the conductors in the plug-receiving socket is connected to an inductor while the two-to-one basis means that, for each pair of conductors in the plug-receiving socket, only one inductor is used, namely one of the two conductors is connected to the inductor.

The present invention has been described in sufficient detail with a certain degree of particularity. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

We claim:

1. An improved phone jack for a phone line system including a data network; said phone jack comprising:

a housing having a rear-receiving end and a plugging end, a plug-receiving socket formed in said rear-receiving end and adapted to receive a modular phone plug; said plugging end being so formed that said plugging end can be plugged into a regular phone jack coupled to said phone line system including said data network;

a number of inductors; and n number of conductors mounted in said housing and having first ends and second ends; said first ends projecting into said plug-receiving socket for engaging a contact of said modular phone plug when said modular phone plug is inserted into said socket; said second ends coupled respectively to said plugging end through said inductors.

2. The improved phone jack as recited in claim 1; wherein said number is n such that each of said conductors is coupled to said plugging end through one of said inductors.

3. The improved phone jack as recited in claim 2; wherein n is 4 such that said plugging end can be plugged into said regular phone jack in a residential home.

4. The improved phone jack as recited in claim 1; wherein said number is n/2 such that every other one of said conductors is coupled to said plugging end through one of said inductors and the rest of said conductors are coupled to said plugging end directly.

5. The improved phone jack as recited in claim 4; wherein n is 4 such that said plugging end can be plugged into said regular phone jack in a residential home.

6. An improved phone jack for a phone line system including a data network; said phone jack comprising:

a housing having a rear-receiving end and a plugging end, a number of plug-receiving sockets formed individually in said rear-receiving end and each adapted to receive a modular phone plug; said plugging end being so formed that said plugging end can be plugged into a regular phone jack coupled to said phone line system including said data network;

n groups of inductance circuits; and n groups of conductors mounted in said housing; each of said conductors having first ends and second ends; said first ends projecting into one of said plug-receiving socket for engaging a contact of said modular phone plug when said modular phone plug is inserted into said one of said plug-receiving socket; said second ends coupled respectively to said plugging end through one of said groups of said inductance circuits.

7. The improved phone plug as recited in claim 6, wherein each of said inductance circuits comprises an inductor.

8. An improved phone plug for a phone line system including a data network; said phone jack comprising:

a housing having a rear-receiving end and a plugging end, a first plug-receiving socket and a second plug-receiving socket formed individually in said rear-receiving end, wherein said first plug-receiving socket is adapted to receive a first modular phone plug from a phone device; said second plug-receiving socket is adapted to receive a second modular phone plug from a computing device;

said plugging end being so formed that said plugging end can be plugged into a regular phone jack coupled to said phone line system including said data network;

n inductors; and a first group and a second group of n conductors mounted respectively in said housing and having first ends and second ends; said first ends of said first group of n conductors projecting into said first plug-receiving socket for engaging a contact of said first modular phone plug when said first modular phone plug is inserted into said first plug-receiving socket; said second ends of said first group of n conductors coupled respectively to said plugging end through said n inductors.

9. The improved phone plug as recited in claim 8, wherein said first ends of said second group of n conductors projecting into said second plug-receiving socket for engaging a contact of said second modular phone plug when said second modular phone plug is inserted into said second plug-receiving socket; said second ends of said second group of n conductors coupled to said plugging end directly.

10. The improved phone jack as recited in claim 9, wherein said first plug-receiving socket is visually labeled for a phone device and said second plug-receiving socket is visually labeled for a computing device.

* * * * *

US006012951C1

(12) EX PARTE REEXAMINATION CERTIFICATE (6483rd)

United States Patent

Krawez et al.

(10) Number: US 6,012,951 C1

(45) Certificate Issued: Oct. 21, 2008

(54) PHONE PLUG FOR A PHONE LINE SYSTEM INCLUDING A HOME DATA NETWORK

(75) Inventors: Cliff Krawez, Santa Clara, CA (US); Paul B. Ripy, Fremont, CA (US)

(73) Assignee: Broadmedia Inc., Sunnyvale, CA (US)

Reexamination Request:
No. 90/007,213, Sep. 16, 2004
No. 90/007,408, Feb. 1, 2005

Reexamination Certificate for:

| | |
|---|---|
| Patent No.: | **6,012,951** |
| Issued: | **Jan. 11, 2000** |
| Appl. No.: | **09/191,883** |
| Filed: | **Nov. 13, 1998** |

(51) Int. Cl.
*H01R 25/00* (2006.01)
*H01R 13/66* (2006.01)

(52) U.S. Cl. ..... 439/620.17

(58) Field of Classification Search ..... 439/620.11, 439/620.17, 620.18, 620.23; 379/399
See application file for complete search history.

(56) References Cited

U.S. PATENT DOCUMENTS

| | | | | |
|---|---|---|---|---|
| 5,139,442 | A | 8/1992 | Sakamoto | 439/620 |
| 5,848,150 | A | 12/1998 | Bingel | 379/399 |
| 5,895,294 | A * | 4/1999 | DeLangis et al. | 439/669 |
| 5,896,443 | A | 4/1999 | Dichter | 379/93.08 |
| 5,933,555 | A | 8/1999 | Shen | 385/32 |
| 5,960,066 | A | 9/1999 | Hartmann | 379/93.08 |
| 6,028,919 | A | 2/2000 | Bingel | 379/142.13 |
| 6,137,865 | A | 10/2000 | Ripy | 379/93.05 |
| 6,144,734 | A | 11/2000 | Beeman | 379/398 |
| 6,205,262 | B1 | 3/2001 | Shen | 385/11 |
| 6,212,259 | B1 | 4/2001 | Kiko | 379/32.01 |
| 6,239,672 | B1 | 5/2001 | Lutz | 333/175 |
| 6,393,111 | B1 | 5/2002 | Ripy | 379/93.05 |

OTHER PUBLICATIONS

Paul Horowitz and Winfield Hill, The Art of Electronics, 2d Ed., 44 (1989).*

Daniel L. Metzger, Electronic Circuit Behavior, 2d Ed. 56 (1983).*

Krieger, "*Radio Frequency Interference: How to Find It and Fix It,*" Copyright © 1991 by *The American Radio Relay League*, 1st Ed., 3rd Printing, 1993, Publication #149 of the Radio Amateur's Library. (15 pgs).

PARADYNE™ HotWire 5038 Distributed POTS Splitter Customer Premises Installation Instructions, Document No. 5038–A2–GN10–00, Feb. 1998 (4 pgs.).

Bell System Practices Section 500–150–100 AT&T Co Standards Issue 7, Jan. 1974, included in email entitled "Telephone Interference", 14 pages in total.

HotWire Indoor POTS Splitter Customer Premises Installation Instructions, Document No. 5034–A2–GN10–00, Aug. 1997, 4 pages in total.

Hotwire 5038 Distributed POTS Splitter Customer Premises Installation Instructions, Document No. 5034–A2–GN10–00, Feb. 1998, 8 pages in total.

HotWire 5038MVL Distributed POTS Splitter Customer Premises Installation Instructions, Document No. 5034–A2–GN11–00, Apr. 1998, 4 pages in total.

* cited by examiner

*Primary Examiner*—Pia F. Tibbits

(57) ABSTRACT

An improved phone plug comprises a housing having a rear-receiving end and a plugging end, a number of inductors and conductors. The plug-receiving socket is formed in the rear-receiving end and adapted to receive a modular phone plug; the plugging end being so formed that the plugging end can be plugged into a regular phone jack coupled to the phone line system including the data network. The conductors are mounted in the housing and have first ends and second ends; the first ends projecting into the plug-receiving socket for engaging a contact of the modular phone plug when the modular phone plug is inserted into the plug-receiving socket; the second ends coupled respectively to the plugging end through the inductors.

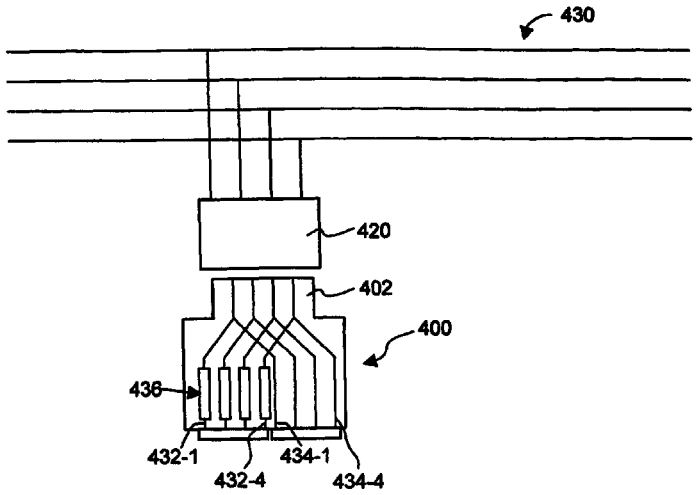

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–10 are cancelled.

* * * * *